United States Patent [19]

Sundheim

[11] 4,191,590

[45] Mar. 4, 1980

[54] METHOD AND APPARATUS FOR CLEANING CARPETS AND SURFACES USING CLEANING FLUID

[75] Inventor: John J. Sundheim, Englewood, Colo.

[73] Assignee: The John J. Sundheim Family Estate, Englewood, Colo.

[21] Appl. No.: 790,593

[22] Filed: Apr. 25, 1977

[51] Int. Cl.[2] ..... B08B 5/04

[52] U.S. Cl. ..... 134/21; 15/50 R; 15/322; 134/34; 134/102; 134/176; 134/181; 239/251

[58] Field of Search ..... 134/21, 34, 37, 102, 134/176, 179, 180, 181; 15/50 R, 320, 321, 322; 239/258, 247, 1, 286, 287, 225, 251; 401/289

[56] References Cited

U.S. PATENT DOCUMENTS

| | | | |
|---|---|---|---|
| 2,588,000 | 3/1952 | Hines | 15/320 |
| 3,079,285 | 2/1963 | Rockwell | 134/21 |
| 3,748,050 | 7/1973 | Poppitz | 15/50 R |
| 3,959,010 | 5/1976 | Thompson et al. | 134/21 |
| 3,964,925 | 6/1976 | Burgoon | 134/21 |
| 4,000,538 | 1/1977 | Tissier | 15/320 |

*Primary Examiner*—S. Leon Bashore
*Assistant Examiner*—George C. Yeung
*Attorney, Agent, or Firm*—Burton & Dorr

[57] ABSTRACT

A method and apparatus for cleaning surfaces using a high velocity stream or streams of cleaning fluid. The high velocity stream or streams issue from one or more nozzles that are moving at a high velocity relative to the surface to be cleaned and are directed at the surface at an inclined angle thereto. In one embodiment, the source of cleaning fluid is under a high pressure of about 200 to 700 pounds per square inch and the nozzles are moving in a direction so that the velocity imparted to the issuing stream by each moving nozzle adds to the already high velocity of the stream due to the high pressure alone of the source of cleaning fluid. In another embodiment, two nozzles are rotated at a high velocity about an axis perpendicular to the surface to be cleaned with each nozzle being directed at a different area of the surface and having a different flow rate, angle of inclination to the surface, spray pattern, and/or spraying arc. The nozzles can be spaced at different distances from the axis of rotation in this embodiment and the closed paths sprayed by the nozzles as they move about an axis can be distinct or overlap. In a preferred embodiment, the nozzle spraying the area farther from the axis of rotation sprays the smaller area and has the greater flow rate. The spray patterns of the nozzles can be solid streams, fans, cones or any desired pattern. In another embodiment, at least three nozzles are directed at the surface to be cleaned and rotated at high velocities about the axis of rotation. In all of the embodiments. the flow rate, spray pattern, angle of inclination to the surface, spraying area, and spraying arc for each nozzle can be individually set and the various nozzle arrangements can be easily removed and substituted one for another in the apparatus. The various nozzle arrangements are new and novel and can be used with improved results in conventional cleaners that operate with the source of cleaning fluid under relatively low pressure. The moving nozzles enable the invention to spray a given area quickly and with a minimum of cleaning fluid. The apparatus can be operated with or without a driving motor for the rotating nozzles. The invention further includes a vacuum pick up system and wall nozzles that enable the invention to clean near walls or at the edge of the carpet.

31 Claims, 11 Drawing Figures

Fig-3
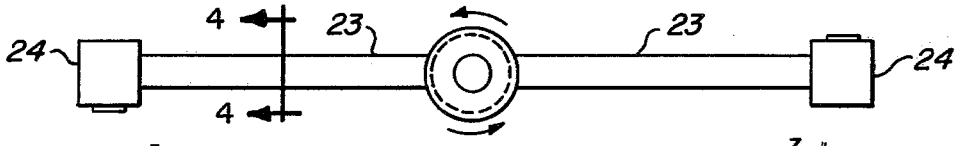
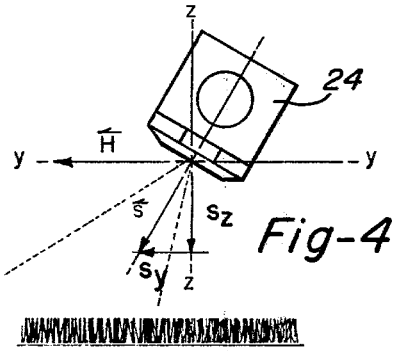
Fig-4
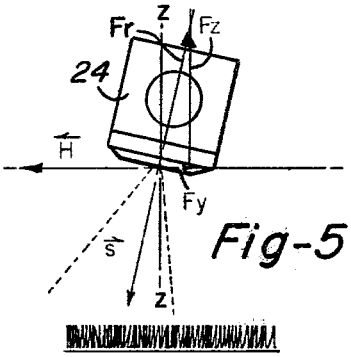
Fig-5
Fig-7
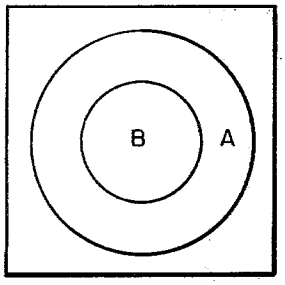
Fig-8
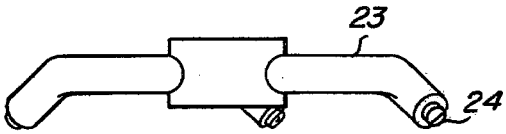
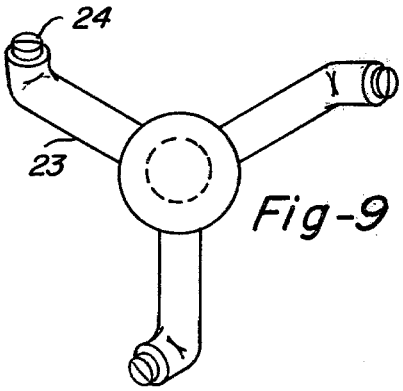
Fig-9
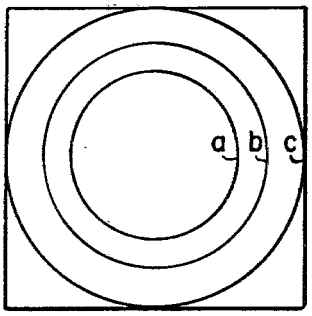
Fig-10

METHOD AND APPARATUS FOR CLEANING CARPETS AND SURFACES USING CLEANING FLUID

FIELD OF THE INVENTION

This invention relates to a method and apparatus for cleaning hard and soft surfaces such as carpets, floors, streets, concrete surfaces, tennis courts, airport runways, and the like with a cleaning fluid. The invention also relates to a method and apparatus for applying any fluid such as air, water, cleaning liquid, and the like to a hard or soft surface.

BACKGROUND OF THE INVENTION

Past methods and apparatuses for cleaning surfaces such as carpets have primarily relied upon the technique of applying a cleaning fluid to the carpet and then scrubbing the carpet with mechanical devices such as brushes. In this general technique, the cleaning fluid can be applied directly to the carpet as in the case of U.S. Pat. No. 1,821,715 to Kuchinsky, issued September, 1931, or can be applied indirectly to the carpet by having the fluid flow through the scrubbing brushes onto the carpet as illustrated in U.S. Pat. No. 2,168,692 to Videl, issued Aug. 8, 1939, U.S. Pat. No. 1,176,990 to Scherff, issued Mar. 28, 1916, and U.S. Pat. No. 3,189,930 to Tuthill, Jr., issued June 22, 1965. A variation of the technique is to apply the cleaning fluid to the carpet both directly and through the brushes as done in U.S. Pat. No. 2,250,177 to Boccasile, issued July 22, 1941. Another variation is to apply the cleaning fluid directly to the carpet through a rotating, hollow scrubbing member as illustrated by U.S. Pat. No. 1,498,255 to Winchester, issued June 17, 1924. The cleaning fluid in such devices is usually fed under low pressure of about 30 to 50 pounds per square inch or by gravity and the actual loosening of the soiling material in or on the carpet is done by the mechanical scrubbing device. Apparatuses that use mechanical scrubbing devices are often bulky and heavy, making them difficult to maneuver and causing them to leave the carpet fibers in a depressed condition. Further, these cleaners have a tendency to rub the soiling material or dirt into the base of the fibers of the carpet rather than remove it from the fibers. The scrubbers in such cleaners generally agitate the carpet and cleaning fluid to create a foam. During the shampooing operation, soiling material in the rug settles down in the piles of the carpet and little of it is removed. After a carpet has been shampooed several times, it reaches a state in which the build-up of residue left from the shampoo itself and the soiling material is so great that shampooing is no longer effective. Further, such cleaners tend to produce a grinding effect in which the fibers of the carpet are pressed against dirt particles and are actually ground up.

Another technique for cleaning carpets is to apply jets or streams of cleaning fluid to the carpet and then remove the cleaning fluid and soiling material from the carpet through a vacuum nozzle. The force of the fluid jet or stream impinging on the carpet loosens the soiling material or dirt. A significant advantage of a cleaner of this type which utilizes a jet of cleaning fluid and a vacuum nozzle in that it removes the soiling material from the carpet rather than merely moving the soiling material down within the piles as happens in shampooing cleaners. Examples of this general technique are U.S. Pat. No. 3,774,262 to Anthony, issued Nov. 27, 1971, 3,614,797 to Jones issued Oct. 26, 1971; U.S. Pat. No. 3,431,582 to Grave issued Mar. 11, 1969; U.S. Pat. No. 3,605,169 to Howerin issued Sept. 20, 1971, and U.S. Pat. No. 3,619,849 to Jones issued Nov. 16, 1971, which supply fluid under pressure to fixed nozzles. U.S. Pat. No. 2,660,744 to Cockrell, issued Dec. 1, 1953, supplies water under pressure to rotatable mounted nozzles which are rotated about a fixed axis by the reaction force of the jets or streams issuing from the nozzles. U.S. Pat. Nos. 2,003,216 to Nadig issued May 28, 1935 and 2,223,963 to Nadig issued Dec. 3, 1940 use a rotary distributor to draw liquid from a source under ambient pressure and to impel the liquid onto the surface to be cleaned. U.S. Pat. No. 3,624,668 to Krause issued Nov. 30, 1971, applies cleaning fluid through moving nozzles directed vertically downward toward the carpet. Krause rotates his vacuum pick up with his cleaning fluid applicators and immediately vacuums the carpet after the cleaning fluid is applied.

SUMMARY OF THE INVENTION

This invention provides a new and novel method and apparatus for efficiently cleaning hard and soft surfaces such as carpets, floors, streets, concrete surfaces, tennis courts, airport runways, and the like through the use of a cleaning fluid. The invention is particularly useful for removing soiling material which has adhered to the fibers of a carpet or lodged at the base of the carpet fibers or become entrapped within the loops of the fibers of the pile of the carpet. The invention cleans the carpet without subjecting it to excessive wear, streaking, unnecessarily strong cleaning fluids, or the heavy weight of previous cleaning devices.

In this invention, a cleaning fluid such as air, water, water containing detergents or other cleansing material, and the like is placed under high pressure and impinged in a stream through a nozzle at a high velocity against the surface to be cleaned. The nozzle and resulting stream are directed at the surface at an inclined angle to the surface and the nozzle itself is moved at a high velocity relative to the surface. In a preferred embodiment, the direction of the movement of the nozzle is such as to add to the already high velocity of the stream issuing from the nozzle due to the high pressure alone of the source of cleaning fluid. In this preferred embodiment, the source of cleaning fluid is under a high pressure of about 200–700 pounds per square inch and the nozzle is located on an arm rotating at a high angular velocity about an axis perpendicular to the surface to be cleaned so that the nozzle is moving at a high velocity of about 40 to 70 feet per second relative to the surface.

The apparatus of the invention can have one or more nozzles on a single or plurality of rotating arms. The flow rate, angle of inclination to the surface, and spraying area of each nozzle can be individually set and a variety of nozzle arrangements can be easily substituted into the apparatus. The moving or rotating nozzles of the invention enable the invention to spray a given area faster using fewer nozzles than previous devices with fixed nozzles. Since fewer nozzles are needed, less cleaning fluid is needed from the source in order to spray the given areas with streams of the same velocity as the streams from devices with fixed nozzles. In a preferred embodiment, the amount of cleaning fluid needed from the source in order to spray the given area with streams of the same velocity as the streams from devices with fixed nozzles is further reduced because the velocity imparted to the stream due to the nozzle moving adds to the velocity of the stream due to the high pressure of the source alone. The invention also includes nozzles that enable the apparatus to apply cleaning fluid to the surface near walls.

The method of the invention includes the step of inclining two or more nozzles toward the surface to be cleaned and moving them relative to the surface wherein the nozzles are directed at different areas of the surface. As the nozzles are moved, the streams issuing therefrom strike different closed paths on a portion of the surface. These paths can be distinct or overlap. The nozzles can be inclined to the surface at different angles, can have different flow rates, can have different spraying patterns, and/or can be spaced at different distances from the axis of rotation. In a preferred embodiment, the nozzle spraying the area farther from the axis of rotation has the greater flow rate and sprays the smaller area. In another embodiment, at least two nozzles are inclined to the surface to be cleaned and directed at different areas of the surface. In this embodiment, the nozzles are mounted for rotation about an axis and the high pressure cleaning fluid from the source issues from each nozzle at an inclined angle to the surface and propels each nozzle about the axis of rotation.

OBJECTS OF THE INVENTION

It is a principle object of this invention to provide a unique and novel method and apparatus for cleaning hard and soft surfaces such as carpets, floors, streets, concrete surfaces, tennis courts, airport runways, and the like through the use of cleaning fluid.

It is a principle object of this invention to provide a new and novel method and apparatus for applying a fluid such as a cleaning fluid and the like to a hard or soft surface.

It is an object to provide a method and apparatus for loosening soiling material from a surface such as a carpet by using a high velocity stream or streams of cleaning fluid.

It is an object to provide a method and apparatus for loosening and removing soiling material from a surface such as a carpet by using a high velocity stream or streams of cleaning fluid and a vacuum source.

Another object is to provide a method and apparatus for applying a cleaning fluid from a source under high pressure in one or more high velocity streams from one or more moving nozzles directed at the surface to be cleaned at an inclined angle to the surface, the one or more nozzles being moved at a high velocity relative to the surface in a direction so that the velocity imparted to such stream of cleaning fluid by each moving nozzle adds to the velocity of the stream due to the high pressure alone of the source of cleaning fluid.

Another object is to provide a method and apparatus for applying high velocity streams of cleaning fluid to a surface using fewer and higher velocity streams of cleaning fluid than previous devices.

Another object is to provide a method and apparatus for applying high velocity streams of cleaning fluid to a surface using a minimum of cleaning fluid from the source.

It is an object to provide a method and apparatus for applying cleaning fluid to a surface in streams from moving nozzles with different spraying areas, different flow rates, different spray patterns, and/or different inclinations to the surface to be cleaned.

Other objects and features of this invention will become apparent by reference to the following specification and to the drawings.

BRIEF DESCRIPTION OF THE DRAWINGS

FIG. 3 is a view taken along line 3—3 of FIG. 2 showing a nozzle arrangement that has two nozzles.

FIG. 4 is a view taken along line 4—4 of FIG. 3 illustrating the direction S of the velocity of the stream issuing from one of the nozzles under the high pressure alone of the source of the cleaning fluid. This Figure also illustrates the component vectors Sy and Sz of that stream and the preferred direction H of movement of the nozzle relative to the surface to be cleaned.

FIG. 5 is a view similar to FIG. 4 illustrating the direction $F_R$ of the reaction force on one of the nozzles due to the stream issuing therefrom under the high pressure alone of the cleaning fluid source. This Figure also illustrates the component vectors Fy and Fz of that reaction force and the preferred direction H of movement of the nozzles relative to the surface to be cleaned.

FIG. 7 is a view along line 7—7 of FIG. 6 showing the different closed paths sprayed by each nozzle.

FIG. 8 illustrates a view of another nozzle arrangement which has three nozzles. The view of FIG. 8 is a view similar to FIG. 6.

FIG. 9 is a view from below of the nozzle arrangement of FIG. 8.

FIG. 10 is an elevated view of the carpet illustrating one possible spray pattern from the nozzle arrangement of FIGS. 8 and 9.

DETAILED DESCRIPTION OF THE PREFERRED EMBODIMENTS

Figure 1:
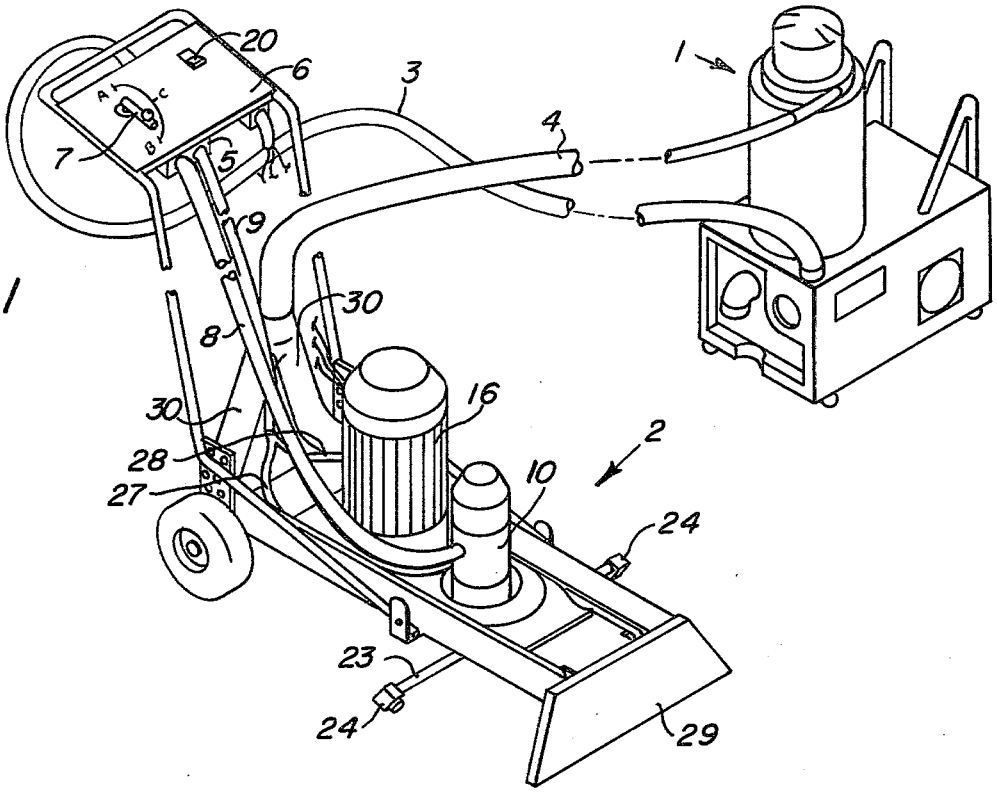
FIG. 1 is a perspective view of the invention showing the tank and floor tool.

As best seen in FIG. 1, one of the preferred embodiments has a movable tank 1 and a movable floor tool 2. The tank 1 can be of conventional design and includes a fluid compressor unit and a vacuum unit. Cleaning fluid added to the tank 1 is put under a high pressure of about 200 to about 700 pounds per square inch by the compressor unit and fed through the line 3 to the floor tool 2. The vacuum unit of the tank 1 places the line 4 from the floor tool 2 under pressure less than ambient.

The cleaning fluid under high pressure in line 3 is fed to a valve 5 below the control panel 6 of the floor tool 2. The lever 7 on the control panel 6 controls valve 5. When the lever 7 is in position A, the high pressure cleaning fluid is fed to line 8. When the lever 7 is in position B, the high pressure cleaning fluid is fed to line 9 and when the lever 7 is in position C, the flow of cleaning fluid is cut off to both line 8 and line 9.

Figure 2:
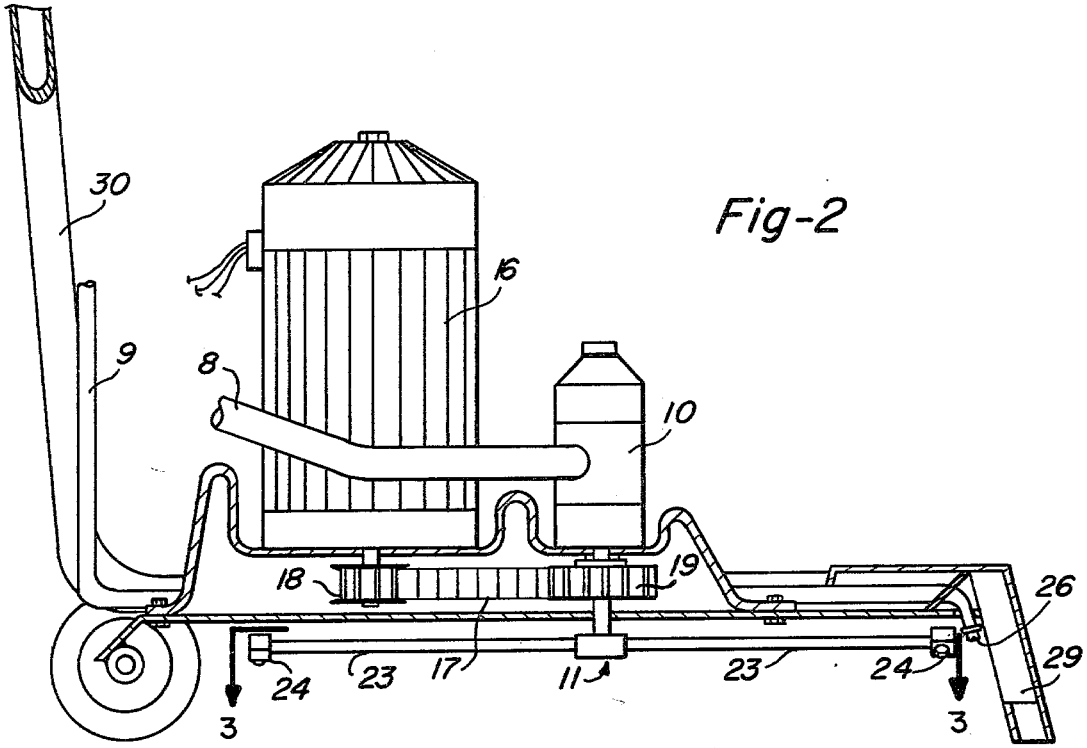
FIG. 2 is a cross-sectional view of the floor tool.
Figure 11:
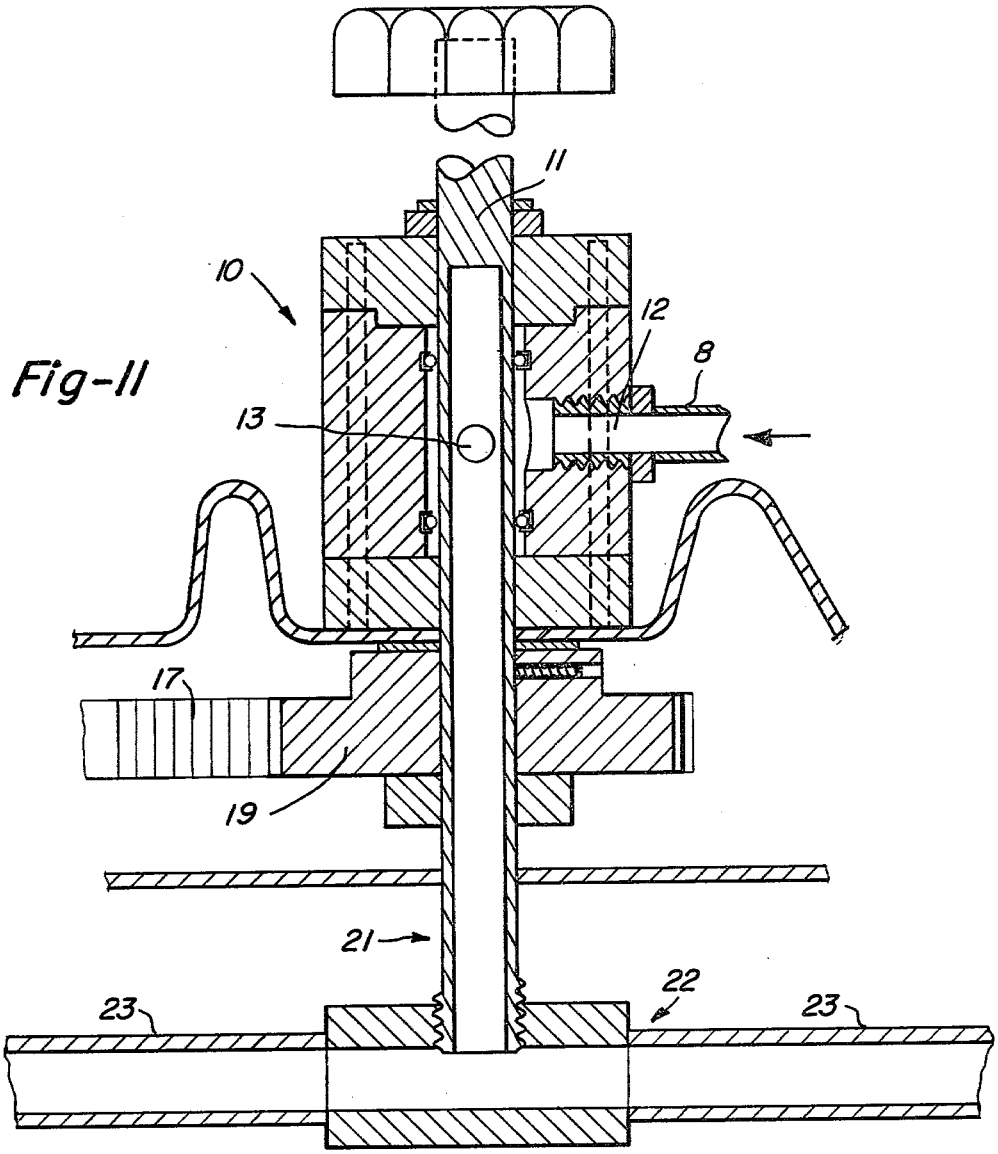
FIG. 11 illustrates a preferred way of supporting the hollow means 11 for rotation about an axis perpendicular to the carpet.

As best seen in FIGS. 2 and 11, line 8 is connected to the interior of cylindrical means 10 which supports hollow means 11 for rotation about an axis substantially perpendicular to the surface to be cleaned. The cylindrical support means 10 has an inlet at 12 and the hollow means 11 has inlet means 13 consisting of diametrically opposed passages into the interior of hollow means 11. The hollow means 11 is rotated about its axis of rotation by the electric motor 16 by means of the toothed drive belt 17 extending between the toothed wheels 18 and 19. The electric motor 16 is controlled by switch 20 on the control panel 6 in FIG. 1. The hollow means 11 in FIG. 11 has a substantially vertical portion 21 and a substantially horizontal portion 22. The horizontal portion 22 is removably attached to the vertical portion 21 and is shown to have two hollow members or arms 23 extending outwardly of the axis of rotation of the hollow means 11. Each hollow member 23 has an outlet nozzle means 24 as shown in FIG. 2.

As seen in FIGS. 3 and 4, each outlet nozzle means 24 directs a stream of cleaning fluid at the carpet at an inclined angle to the carpet. The angle of inclination can vary over a wide range but is preferable about 60 to about 85 degrees. The outlet nozzle means 24 are of conventional design and can have spray patterns such as cones, solid streams, fans, or any desired pattern. The stream of cleaning fluid issuing from each outlet nozzle means 24 due to the high pressure alone of the source of cleaning fluid has a resulting vector S in FIG. 4. The vector S has component vectors (i.e., vectors projected on the x, y, and z axes) of Sy in the direction of the y axis and Sz in the direction of the z axis. For purposes of illustration, the vector S is shown as being in the y-z plane but it can have almost any forward direction. Preferable, the vector S is outside of any plane that includes the axis of rotation of hollow means 11. In a preferred embodiment, the outlet nozzle means 24 is moved in FIG. 4 in the direction of the vector H so that the velocity imparted to the stream by the moving outlet nozzle means 24 adds to the existing velocity of the stream issuing from the outlet nozzle means 24 due to the high pressure alone of the source of the cleaning fluid. In other words, the vector of the moving outlet nozzle means 24 (vector H in this case) is along the axis of a coordinate system in the same direction as a component vector (Sy in this case) of the stream issuing from the outlet nozzle means 24 due to the high pressure alone of the cleaning fluid source. This illustration uses a coordinate system in which the vector H is directed along one axis, however, the same relationship hold true if one axis of the coordinate system is along the vector S. In that case, a component vector of vector H will be in the same direction as vector S. The reference coordinate systems of the above examples are instantaneous systems and move with the reference vector H or S about the axis of rotation of the hollow means 11. The reference vector H or S defines one axis of the coordinate system. This moving of the outlet nozzle means 24 so that the head portion of the stream where the high pressure cleaning fluid encounters ambient pressure is moved in the direction H produces a superior cleaning nozzle.

FIG. 5 illustrates the same idea in terms of the reaction force $F_R$ on the outlet nozzle means 24 created by the stream issuing therefrom due to the high pressure alone of the source of cleaning fluid. The reaction force $F_R$ is in the opposite direction from the stream vector S. The vector H of the outlet nozzle means 24 is still directed along an axis of a coordinate system and the reaction force $F_R$ has component vectors Fy in the direction of the y axis and Fz in the direction of the z axis. In this case, the movement of the outlet nozzle means 24 (vector H) is along an axis of the coordinate system in a direction opposite to a component vector (Fy) of the reaction force $F_R$. The same relationship holds true if one of the axes of the coordinate system is along the vector $F_R$. In that case, a component vector of vector H will be in the opposite direction of vector $F_R$. The coordinate systems of the above examples move with the reference vector H or $F_R$ about the axis of rotation of the hollow means 11. The reference vector H or $F_R$ defines one axis of the coordinate system. As also seen in FIG. 5, some of the stream issuing from outlet nozzle means 24 can spray to the right of the z axis as long as the resulting vector S of the stream is to the left of the z axis in FIG. 5.

Figure 6:
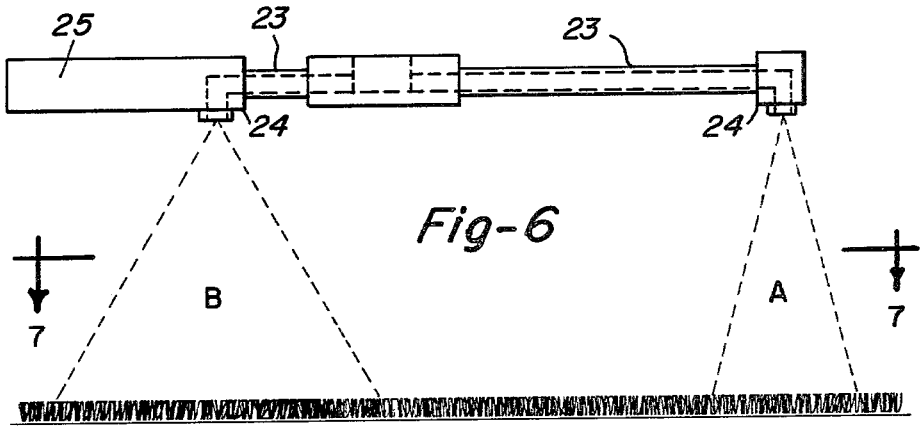
FIG. 6 is a view similar to FIG. 2 showing the invention with a different nozzle arrangement. The nozzles in this arrangement are spaced at different distances from the axis of rotation and spray different areas of the carpet.

A principle feature of one preferred embodiment of the invention is that each outlet nozzle means 24 sprays a different area of the surface to be cleaned. As seen in FIGS. 6 and 7, one of the outlet nozzle means 24 is directed at an annular area or path A spaced from the axis of rotation of the hollow means 11 while the second outlet nozzle means sprays the area or path B from the axis of rotation out to the area A. Paths A and B that are sprayed as the outlet nozzles means 24 are moved about the axis can be distinct paths that are adjacent to each other or spaced from each other. Paths A and B can also overlap. In a preferred embodiment, each outlet nozzle means 24 is spaced a different distance from the axis of rotation as shown in FIG. 6 with a counter weight 25 added to the outlet nozzles means 24 that is closer to the rotation axis to balance the forces of the rotating hollow members 23. Each outlet nozzles means 24 can have a different flow rate, different angle of inclination to the surface to be cleaned, and different arc to the stream issuing from the outlet nozzle means 24. In a preferred embodiment, the outlet nozzle means 24 spaced farther from the axis of rotation sprays a smaller area, has a greater flow rate, and has a smaller spraying arc than the other outlet nozzle means 24 that is closer to the axis of rotation. For example, the respective flow rates can be 1.0 gallons per minute and 0.5 gallons per minute and the respective areas can be 65° and 110°. If the outlet nozzle means 24 are directed at different areas of the carpet and spaced the same distance from the axis of rotation as in the apparatus of FIG. 2, the velocity of each outlet nozzle means 24 relative to the carpet is the same. If the spacing is different, then the outlet nozzle means 24 farther from the axis moves at a higher velocity relative to the carpet than the other outlet nozzle means 24.

Another preferred nozzle arrangement is illustrated in FIGS. 8–10. In this embodiment, the hollow members 23 have elbows of approximately 135° and the outlet nozzle means 24 spray solid streams. Each outlet nozzle means 24 is inclined at a different angle to the surface to be cleaned and sprays a different substantially annular path a, b, and c. The streams being sprayed are very concentrated and the annular paths a, b, and c are very thin and spaced from each other.

In all of the embodiments of this invention, the outlet nozzle means 24 on each hollow member 23 can be individually set as to flow rate, angle of inclination to the surface to be cleaned, spray area and spray pattern. Further, each nozzle arrangement as illustrated in FIGS. 2, 6 and 8 can be easily removed and replaced by another nozzle arrangement by holding the vertical portion 21 of the hollow means 11 still and unscrewing the horizontal portion 22. These unique and new nozzle arrangements also work well on conventional cleaning devices which operate with the cleaning fluid under relatively low pressure. The outlet nozzles means 24 can also be directed vertically downward toward the carpet and driven about the rotational axis by the motor 16.

The invention also includes providing wall nozzles 26 which are connected to line 9 by lines 27 and 28 as seen in FIGS. 1 and 2. When the lever 7 is in position B, cleaning fluid under high pressure is fed to the wall nozzles 26 through lines 27 and 28 from line 9. The wall nozzles 26 preferably spray a fan pattern right up against the vacuum manifold 29 in FIG. 2. In this manner, the floor tool 2 can reach an area of the carpet next to a wall.

The vacuum system of the invention includes the vacuum manifold 29 and the bifurcated pipe means 30 connected by line 4 to the vacuum unit of the tank 1 as best seen in FIGS. 1 and 2.

In operation, the fluid compressor unit and vacuum unit of the tank 1 are activated to place the cleaning fluid under a high pressure of about 200 to about 700 pounds per square inch and to draw a vacuum through the floor tool's vacuum system of line 4, pipe means 30 and vacuum manifold 29. The high pressure cleaning fluid is fed from the tank 1 through line 3 to the valve 5 under the control panel 6 of the floor tool 2. Lever 7 is placed in position C to prevent the cleaning fluid from entering line 8 or line 9. The floor tool 2 is then moved to place the vacuum manifold 29 next to a wall or at the edge of the carpet and the lever 7 is moved to position B to feed high pressure cleaning fluid through lines 9, 27 and 28 to the wall nozzles 26. The cleaning fluid issues from end wall nozzle 26 in a fan pattern close to the wall or edge of the carpet. Lever 7 is then moved to position C to shut off the flow to the wall nozzles 26 and switch 20 is turned on to start the electric motor 16 which rotates the hollow means 11. Lever 7 is moved to position A to feed high pressure cleaning fluid through line 8 to the cylindrical support means 10 through the inlet 12. The cleaning fluid passes into the rotating hollow means 11 through inlet means 13 and issues from each outlet nozzles means 24 in a high velocity stream. The floor tool 2 is pulled toward the operator away from the wall as it is moved over the carpet.

The electric motor 16 is about a $\frac{1}{3}$ to 1/6 horsepower motor and rotates the hollow means 11 at about 700 to 900 revolutions per minute. As illustrated in FIGS. 3–5, each of the stream S creates a reaction force $F_r$ on the respective nozzle means 24 that tends to propel the nozzle means 24 in a second direction opposite to that of the stream S. These reaction forces create a net force tending to move the common horizontal portion 22 and plural nozzle means 24 about an axis of rotation substantially perpendicular to the surface to be cleaned in a first rotational direction (clockwise) as illustrated in FIG. 3. The drive arrangement of members 16–19 then serves to rotate the common horizontal portion 22 and plural nozzle means 24 about the rotational axis in a second rotational direction (counterclockwise in FIG. 3) opposite to the first rotational direction. The outlet nozzle means 24 are about 7 to 12 inches from the axis of rotation and are moved at about 40 to 70 feet per second relative to the surface of the carpet. The cleaning fluid issues from each outlet nozzle means 24 and wall nozzle 26 at about 150 to about 350 feet per second under the high pressure alone (200 to 700 pounds per square inch) of the source of the cleaning fluid. The cleaning fluid is preferable under about 600 to about 700 pounds per square inch. The outlet nozzle means 24 are inclined to the surface at about 60° to about 85° and are moved in a direction so that the velocity imparted to the stream due to the moving outlet nozzle means 24 adds to the already high velocity of the stream due to the high pressure alone of the cleaning fluid source.

In the preferred embodiments, each outlet nozzle 24 in FIGS. 2, 6 and 8 is directed at different areas of the carpet in a plane perpendicular to the axis of rotation of the hollow means 11 and spray different paths. The preferred embodiment of FIG. 6 has uneven hollow members 23 so that the outlet nozzle means 24 are located at different distances from the axis of rotation of the hollow means 11. Each outlet nozzles means 24 sprays a different area of the carpet, has a different flow rate, has a different angle of inclination to the carpet, and has a different arc to the stream. The outlet nozzle means 24 farther from the axis of rotation sprays a smaller area at a higher flow rate and with a smaller spraying arc than the outlet nozzle means 24 closer to the axis. The paths sprayed by the streams issuing from the outlet nozzle means 24 as they are moved about the axis can be distinct or overlap. The respective flow rates are about 1.0 gallons a minute and 0.5 gallons a minute and the respective arcs of the streams are about 65° and 110°.

All of the embodiments of this invention work particularly well on carpets. As the floor tool 2 is moved over the carpet, the streams issuing from each outlet nozzle means 24 strike the fibers of the carpet from virtually all directions to loosen any soiling material by breaking or dissolving any adhesive or electrostatic bonding between the soiling material and the carpet fibers. The embodiment of FIGS. 6 and 7 demonstrate a novel feature of the invention that has proven to be far superior to previous devices for cleaning carpets. As the floor tool 2 is moved over the carpet, the outlet nozzle means 24 in FIG. 6 with the greater flow is farther from the axis of rotation and sprays a given area of the carpet first and last before the area is subjected to the reduced pressure of the vacuum manifold 29. This procedure cleans carpets more efficiently and without streaking. In all of the embodiments, the streams issuing from the moving outlet nozzle means 24 repeatedly strike a closed path on a portion of the surface to be cleaned before the surface portion is subjected to the vacuum. As the floor tool 2 is moved across the surface, the paths sprayed by each outlet nozzle means 24 form a progression of closed paths.

The spraying pattern of each outlet nozzle means 24 can be a solid stream, fan, cone, or any desired pattern. The flow rate, angle of inclination to the surface, spraying arc, and spraying area of each outlet nozzle means 24 can be individually set. Further, the nozzle arrangements of FIGS. 2, 6 and 8 can be easily removed and substituted one for the other in the apparatus.

The invention can be operated without the electric motor 16 and toothed drive belt 17 whereby the hollow means 11 is propelled about its axis by the reaction forces on the inclined outlet nozzle means 24 created by the streams issuing therefrom under the high pressure of the cleaning fluid source. The invention can also be operated with the electric motor 16 and toothed drive belt 17 rotating the hollow means 11 in the direction of the reaction forces. One advantage of having the electric motor 16 drive the hollow means 11 is that the rotation of the hollow means 11 can reach a high angular velocity faster than otherwise possible. Without an electric motor 16, the hollow means 11 will reach a high angular velocity of about 600 to 800 revolutions per minute under the influences of the high pressure cleaning fluid but will take some time to do it. The hollow means 11 is preferably rotated by the electric motor 16 and toothed drive belt 17 in a direction so that the velocity imparted by the moving outlet nozzle means 24 to the stream at the head portion where it leaves the outlet nozzle means 24 adds to the already high velocity of the stream due to the high pressure alone of the cleaning fluid. In this manner, energy from the high pressure cleaning fluid is not spent driving the hollow means 11 and the force of the streams impinging against the carpet surface is increased. This preferred method of driving the hollow means 11 increases the cleaning efficiency of the apparatus by about 30% to 40%.

The invention can be used to apply any fluid such as cleaning fluid and the like to a surface. The pressure and velocity ranges given are intended as mere examples. These ranges have been found to work particularly well when the invention is used to clean carpets. The invention has been operated at pressures above 1200 pounds per square inch and it is within the scope of the invention that the velocities and pressures could be increased or decreased beyond the ranges cited in the examples. It is also to be understood that the various nozzle arrangements and combinations of outlet nozzle means 24 are new and novel and can be used with improved results in conventionally cleaning devices that operated with cleaning fluid under relatively low pressure.

Although different embodiments and methods of this invention have been illustrated and described and variations thereof indicated, it will be understood that other embodiments may exist and that various charges may be made without departing from the spirit and scope of this invention.

I claim:

1. A method for cleaning hard and soft surfaces such as carpets, floors, streets, and the like by using a plurality of high velocity streams of cleaning fluid from a source under high pressure, the method comprising the steps of:

(a) forming a plurality of high velocity streams of cleaning fluid by exposing said source of cleaning fluid under high pressure to ambient pressure through a plurality of nozzle means, (b) mounting each of said plurality of nozzle means for rotation about an axis substantially perpendicular to the surface to be cleaned, (c) directing each of said high velocity streams of cleaning fluid through the respective nozzle means against the surface to be cleaned at an inclined angle to said surface, and (d) utilizing power means to move the nozzle means of each and every respective high velocity stream of cleaning fluid at a high angular velocity about said axis of rotation in a direction so that the velocity imparted to each respective stream of cleaning fluid by the respective moving of the nozzle means adds to the existing velocity to effect increased cleaning efficiency of the respective directed stream of step c.

2. The method of claim 1 wherein the source of cleaning fluid in step a is placed under a high pressure of about 200 to about 700 pounds per square inch, the velocity of each of said plurality of velocity streams of step b is about 150 to about 350 feet per second, and the annular velocity of step d is about 700 to 900 revolutions per minute.

3. The method of claim 1 further including the step of:

(e) moving said axis of rotation relative to said surface to be cleaned.

4. The method of claim 1 further including the step of:

(f) subjecting the surface to a pressure less than ambient.

5. The method of claim 1 wherein each of said high velocity streams has a head portion where the cleaning fluid under high pressure from the source meets ambient pressure at the respective nozzle means and the vector of the high velocity moving of the nozzle means at the head portion of each respective stream of cleaning fluid in step d is along an axis of an instantaneous coordinate system in the same direction as component vector in said instantaneous coordinate system of the respective directed velocity stream of step c so that the velocity imparted to each stream of cleaning fluid by the respective moving of the nozzle means thereof adds to the existing velocity of the respective directed stream of step c.

6. The method of claim 1 wherein each of said high velocity streams has a head portion where the cleaning fluid under high pressure from the source meets ambient pressure at the respective nozzle means and the directing of each respective stream in step c creates a reaction force force on the respective nozzle means in a direction opposite to the direction of each high velocity stream directed against said surface and the vector of the high velocity moving of the nozzle means at the head portion of each respective stream in step d is along an axis of an instantaneous coordinate system in a direction opposite to a component vector in said instantaneous coordinate system of the respective reaction force resulting from step c.

7. A method for cleaning hard and soft surfaces such as carpets, floors, streets, and the like by using a plurality of high velocity streams of cleaning fluid from a source under pressure, said method comprising the steps of:

(a) forming a plurality of high velocity streams of cleaning fluid by exposing said source of cleaning fluid under pressure to ambient pressure through a plurality of nozzle means, (b) mounting each of said plurality of nozzle means to a common means for rotation with said common means about an axis substantially perpendicular to the surface to be cleaned, (c) directing each of said plurality of streams in a respective first direction through the respective nozzle means, each respective stream creating a reaction force on the respective nozzle means in a second direction opposite to said first direction, said reaction forces creating a net force tending to move said common means and plurality of nozzle means about said rotational axis in a first rotational direction, and, (d) utilizing power means to drive said common means and said plurality of nozzle means about said rotational axis in a second rotational direction opposite to said first rotational direction to effect increased cleaning efficiency.

8. A method of claim 7 further including the step of:

(e) moving the rotational axis relative to said surface.

9. The method of claim 8 further including the step of:

(f) subjecting said surface to pressure less than ambient.

10. The method of claim 7 wherein step b further includes mounting at least two of said nozzle means at different distances from said axis.

11. The method of claim 7 wherein step c further includes directing at least two of said streams toward different areas of the surface.

12. The method of claim 11 wherein the different areas in step c are distinct.

13. The method of claim 11 wherein the different areas of step c overlap.

14. The method of claim 11 wherein each of said at least two streams has a different flow rate.

15. The method of claim 11 wherein one of said at least two streams is directed at an area farther from said axis of rotation than the other of the two streams and the stream directed at the farther area has the greater flow rate.

16. A method for cleaning hard and soft surfaces such as carpets, floors, streets, concrete surfaces, tennis courts, and the like by using at least two high velocity streams of cleaning fluid from a source under pressure, said method comprising the steps of:

(a) placing the source of cleaning fluid under high pressure, (b) forming at least two high velocity streams of cleaning fluid with different flow rates by exposing said source of cleaning fluid under high pressure to ambient pressure through at least two different openings located at least two distinct locations from an axis, said axis being substantially perpendicular to said surface, each of said high velocity streams having a head portion where the cleaning fluid under high pressure from the source meets ambient pressure at the respective opening, (c) directing each of said high velocity streams of cleaning fluid against the surface to be cleaned at an inclined angle to said surface, each of said streams being directed against different areas of the surface, the area against which said stream with the greater flow rate is directed being spaced farther from said axis than the area against which the stream with the lesser flow rate is directed, (d) moving the head portion of each high velocity stream of cleaning fluid at a high annular velocity about said axis, and, (e) moving the axis of rotation relative to the surface to be cleaned whereby a section of the surface to be cleaned is first struck with a first amount of fluid from the stream with the greater flow rate, a lesser amount of fluid from the stream with the lesser flow rate, and then a third amount of fluid from the stream with the greater flow rate, said first and third amounts being equal.

17. The method of claim 16 wherein the vector of the high velocity moving of the head portion of each respective stream of cleaning fluid relative to said surface in step d is along the axis of an instantaneous coordinate system in the same direction as a component vector in said coordinate system of the respective directed velocity stream of step c so that the velocity imparted to each respective stream of cleaning fluid by the respective moving of the head portion thereof adds to the existing velocity of the respective directed stream of step c.

18. The method of claim 16 further including the step of:

(e) moving said axis of rotation relative to said surface to be cleaned.

19. The method of claim 16 wherein each of said openings is spaced a different distance from said axis and the opening forming the stream with the greater flow rate is located farther from said axis than the opening forming the stream with the lesser flow rate.

20. The method of claim 16 wherein the greater flow rate is about twice the lesser flow rate.

21. The method of claim 16 wherein the streams of step c are directed against overlapping areas of said surface to be cleaned.

22. The method of claim 16 wherein the stream with the greater flow rate is directed at a smaller area than the stream with the lesser flow rate.

23. The method of claim 16 wherein the directing of each respective stream in step c creates a reaction force in a direction opposite to the direction of each high velocity stream directed against said surface and the vector of the high velocity moving of each head portion of the high velocity stream relative to the surface in step d is along an axis of an instantaneous coordinate system in a direction opposite to a component vector in said instantaneous coordinate system of the respective reaction force resulting form step c.

24. The method of claim 16 further including the step of:

(f) subjecting the surface to pressure less than ambient.

25. An apparatus for cleaning hard and soft surfaces such as carpets, floors, streets, concrete surfaces, tennis courts, and the like by using a plurality of high velocity streams of cleaning fluid from a source under pressure, said apparatus comprising:

hollow means having inlet means, means to support said hollow means for rotation about an axis substantially perpendicular to the surface to be cleaned, said hollow means having a plurality of hollow members extending outwardly of said axis of rotation, each of said hollow members having outlet nozzle means spaced from said axis of rotation, said support means supporting said hollow means with said outlet nozzle means of each hollow member directed toward the surface to be cleaned at an inclined angle to said surface, means to supply cleaning fluid under high pressure to said hollow means through said inlet means whereby said high pressure cleaning fluid passes out of said hollow means through each of said outlet nozzle means in at least one high velocity stream from each outlet nozzle means, each of said streams being directed toward the surface to be cleaned at an inclined angle to said surface, and power means to rotate said hollow means about said axis of rotation to move the outlet nozzle means of each and every hollow member about said axis of rotation at a high velocity relative to the surface to be cleaned in a direction so that the velocity imparted to each respective stream by the moving of the respective outlet nozzle means adds to the existing velocity to effect increased cleaning efficiency of said respective stream created by the high pressure cleaning fluid passing through said respective outlet nozzle means.

26. The apparatus of claim 25 further including: means to subject said surface to pressure less than ambient.

27. The apparatus of claim 25 wherein said rotating means moves each outlet nozzle means about said axis and the vector of each respective moving is in a direction along an axis of an instantaneous coordinate system in the same direction as a component vector in said instantaneous coordinate system of the respective stream passing out of the respective outlet nozzle means.

28. The apparatus of claim 25 wherein said stream passing out of each respective outlet nozzle means creates a reaction force on the respective outlet nozzle means in a direction opposite to the direction of said stream and said rotating means moves each of said outlet nozzle means in a direction along an axis of an instantaneous coordinate system opposite to the direction of a component vector in said instantaneous coordinate system of said respective reaction force.

29. The apparatus of claim 25 wherein the supply means supplies the cleaning fluid under high pressure of about 200 to about 700 pounds per square inch, the velocity of each high velocity stream is about 150 to about 350 feet per second, and the velocity of each outlet nozzle means relative to the surface to be cleaned is about 40 to about 70 feet per second.

30. An apparatus for cleaning hard and soft surfaces such as carpets, floors, streets, concrete surfaces, tennis courts, and the like by using a plurality of high velocity streams of cleaning fluid from a source under pressure, said apparatus comprising:

hollow means having inlet means, means to support said hollow means for rotation about an axis substantially perpendicular to the surface to be cleaned, said hollow means having a plurality of hollow members extending outwardly of said axis of rotation, each of said hollow members having outlet nozzle means spaced from said axis of rotation, said support means supporting said hollow means with said outlet nozzle means of each hollow member directed in a first direction, means to supply cleaning fluid under high pressure to said hollow means through said inlet means whereby said high pressure cleaning fluid passes out of said hollow means through each of said outlet nozzle means in at least one high velocity stream from each outlet nozzle means, each respective stream creating a reaction force on the respective outlet nozzle means in a second direction opposite to said first direction, said reaction forces creating a net force tending to move said hollow means about said rotational axis in a first rotational direction, and, power means to rotate said hollow means about said rotational axis in a second rotational direction opposite to said first rotational direction to effect increased cleaning efficiency.

31. The apparatus of claim 30 further including means to subject said surface to pressure less than ambient.

* * * * *